US009453490B2

(12) United States Patent
Nakano et al.

(10) Patent No.: US 9,453,490 B2
(45) Date of Patent: Sep. 27, 2016

(54) CONNECTION DEVICE, IGNITER AND IGNITION SYSTEM

(75) Inventors: Daisuke Nakano, Kiyosu (JP); Naofumi Yamamura, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 295 days.

(21) Appl. No.: 14/116,606

(22) PCT Filed: Apr. 25, 2012

(86) PCT No.: PCT/JP2012/061009

§ 371 (c)(1),
(2), (4) Date: Nov. 8, 2013

(87) PCT Pub. No.: WO2012/169291

PCT Pub. Date: Dec. 13, 2012

(65) Prior Publication Data

US 2014/0070717 A1 Mar. 13, 2014

(30) Foreign Application Priority Data

Jun. 7, 2011 (JP) ..... 2011-126898

(51) Int. Cl.
*F02P 3/02* (2006.01)
*F02P 3/00* (2006.01)
(Continued)

(52) U.S. Cl.
CPC ..... *F02P 3/00* (2013.01); *F02P 9/007* (2013.01); *F02P 3/0435* (2013.01); *F02P 3/08* (2013.01); *H01F 27/40* (2013.01); *H01F 38/12* (2013.01); *H01T 13/00* (2013.01)

(58) Field of Classification Search
USPC ..... 315/209 R–209 SC
See application file for complete search history.

(56) References Cited

U.S. PATENT DOCUMENTS 3,280,809 A 10/1966 Issler
4,034,731 A * 7/1977 Sato ..... F02P 1/083 123/599

(Continued)

FOREIGN PATENT DOCUMENTS

DE 10 2008 041 085 A1 2/2009
EP 2 239 458 A1 10/2010

(Continued)

OTHER PUBLICATIONS

JPO/ISA, International Search Report issued in the international stage of subject application, PCT/JP2012/061009, mailed Aug. 7, 2012.

(Continued)

*Primary Examiner* — Brandon S Cole
(74) *Attorney, Agent, or Firm* — Stites & Harbison, PLLC; Jeffrey A. Haeberlin; James R. Hayne

(57) ABSTRACT

A connection device for connecting a first power supply and a second power supply to an ignition plug has a first power supply side line which establishes electrical connection between the ignition plug and the first power supply and which is electrically connected to the second power supply, and a second power supply side line which establishes electrical connection between the ignition plug and the second power supply. The first power supply side line includes a first diode which prevents a current inflow from the second power supply into the first power supply or a current inflow from the first power supply into the second power supply, and an inductor disposed between the first diode and the ignition plug. The inductor is disposed around the second power supply side line while being separated from the second power supply side line. Thus, noise can be suppressed.

16 Claims, 11 Drawing Sheets

(51) Int. Cl.

| | |
|---|---|
| ***F02P 9/00*** | (2006.01) |
| *F02P 3/04* | (2006.01) |
| *H01F 38/12* | (2006.01) |
| *H01T 13/00* | (2006.01) |
| *H01F 27/40* | (2006.01) |
| *F02P 3/08* | (2006.01) |

(56) References Cited

U.S. PATENT DOCUMENTS

| | | | | |
|---|---|---|---|---|
| 4,327,702 | A * | 5/1982 | Imai | F02P 9/007 123/620 |
| 8,033,273 | B2 * | 10/2011 | Kato | F02P 9/007 123/596 |
| 8,860,419 | B2 * | 10/2014 | Tanaya | F02D 35/021 324/393 |
| 8,973,562 | B2 * | 3/2015 | Tanaya | F02P 3/053 123/620 |
| 2009/0007893 | A1 * | 1/2009 | Kato | F02P 23/04 123/596 |
| 2009/0235889 | A1 | 9/2009 | Yamada et al. | |
| 2010/0132666 | A1 * | 6/2010 | Sato | H01T 13/50 123/406.19 |
| 2010/0259172 | A1 * | 10/2010 | Nakano | H01T 13/50 315/71 |
| 2011/0297131 | A1 * | 12/2011 | Nakano | F02P 9/007 123/596 |
| 2012/0013262 | A1 * | 1/2012 | Nakano | F02P 3/09 315/209 CD |
| 2013/0269643 | A1 * | 10/2013 | Kameda | F02P 3/01 123/169 R |

FOREIGN PATENT DOCUMENTS

| | | | |
|---|---|---|---|
| JP | 55-142970 | A | 11/1980 |
| JP | UM A 55-172659 | A | 12/1980 |
| JP | S56-165391 | U | 12/1981 |
| JP | S57-99272 | A | 6/1982 |
| JP | UM A 57-99967 | | 6/1982 |
| JP | 2009030593 | A1 | 2/2009 |
| JP | 2009-085038 | A | 4/2009 |
| JP | 04390008 | B2 | 10/2009 |
| JP | 2009228505 | A | 10/2009 |
| JP | 2010-257949 | A | 11/2010 |

OTHER PUBLICATIONS

European Patent Office, Supplementary European Search Report, issued in corresponding European application No. 12796064, mailed Sep. 21, 2015.

JPO, Notification of Reason for Rejection issued in corresponding Japanese application No. 2012-020801, dispatched Mar. 3, 2015.

* cited by examiner

CONNECTION DEVICE, IGNITER AND IGNITION SYSTEM

TECHNICAL FIELD

The present invention relates to a connection device for an ignition plug, an ignition apparatus (igniter), and an ignition system.

BACKGROUND ART

In general, an ignition apparatus used for an ignition plug such as a plasma jet ignition plug includes a power supply which applies a voltage to a gap formed between a center electrode and a ground electrode of the ignition plug to thereby generate a spark discharge, and a power supply for supplying electric power to the gap. Also, a connection device for connecting the two power supplies to the ignition plug has a first power supply side line which establishes connection between the ignition plug and the power supply (first power supply) for supplying electric power to the gap, and a second power supply side line which establishes connection between the ignition plug and the power supply (second power supply) for applying a voltage to the gap. A diode is provided between the ignition plug and the first power supply, and another diode is provided between the ignition plug and the second power supply, to thereby prevent a current flow from one of the first and second power supplies into the other of the first and second power supplies (see, for example, Patent Document 1, etc.).

Incidentally, in an ignition apparatus as described above, a large current flows into the ignition plug immediately after generation of spark discharge, and electromagnetic wave noise may be generated. This phenomenon occurs because charges stored in stray capacitances present between the ignition plug and the two diodes instantaneously flow to the gap immediately after generation of spark discharge while hardly being restrained by the resistance components of the lines. A method for restraining generation of such noise has been proposed (see, for example, Patent Document 2, etc.). In the proposed method, a resistor is provided between the ignition plug and the second power supply, the resistor is disposed as close as possible to the center electrode of the ignition plug, and the diode provided between the ignition plug and the first power supply is disposed as close as possible to the center electrode, to thereby minimize the length of the wiring between the ignition plug and the resistor and the length of the wiring between the ignition plug and the diode on the first power supply side. This method can reduce the stray capacitance between the ignition plug and the resistor and the stray capacitance between the ignition plug and the diode on the first power supply side (in other words, charges which instantaneously flow to the gap without being restrained by the resistance components), whereby noise can be suppressed.

PRIOR ART DOCUMENTS

Patent Documents

Patent Document 1: Japanese Patent Application Laid-Open (kokai) No. 2009-228505

Patent Document 2: Japanese Patent No. 4390008

SUMMARY OF THE INVENTION

Problems to be Solved by the Invention

Incidentally, in order to dispose the first power supply side diode at a position as close as possible to the center electrode, the diode must be disposed in a plug hole of a combustion apparatus (e.g., an internal combustion engine or the like). However, the first power supply side diode must have a reverse withstanding voltage equal to or greater than the voltage applied from the second power supply to the ignition plug, and a large current capacity which allows a large current to flow from the first power supply to the ignition plug. Since a diode which satisfies these requirements is relatively large in size, disposing such a diode within the plug hole is very difficult. The shape of the plug hole may be changed (for example, the diameter of the plug hole may be increased) so as to enable the diode to be disposed within the plug hole. However, in this case, the diode may be broken due to heat generated as a result of operation of the combustion apparatus (notably, in recent years, decreasing the size of a combustion apparatus has been demanded; therefore, in reality, it is difficult to change the shape of the plug hole, which may result in an increase in the size of the apparatus).

The present invention has been conceived in view of the above circumstances, and an object of the invention is to provide a connection device, an ignition apparatus, and an ignition system which can suppress noise without depending on the diode on the first power supply side.

Means for Solving the Problems

Configurations suitable for achieving the above object will next be described in itemized form. If needed, actions and effects peculiar to the configurations will be additionally described.

Configuration 1. A connection apparatus of the present configuration is a connection device for connecting a first power supply and a second power supply to an ignition plug, characterized by comprising:

a first power supply side line which establishes electrical connection between the ignition plug and the first power supply and which is electrically connected to the second power supply; and a second power supply side line which establishes electrical connection between the ignition plug and the second power supply, wherein the first power supply side line includes a first diode which prevents a current inflow from the second power supply into the first power supply or a current inflow from the first power supply into the second power supply, and an inductor disposed between the first diode and the ignition plug, and the inductor is composed of a wound metal wire and is disposed around at least a portion of the second power supply side line while being separated from at least the second power supply side line.

According to the above-described configuration 1, the inductor is provided in the first power supply side line for establishing electrical connection between the ignition plug and the first power supply such that the inductor is located on the ignition plug side (downstream side) of the first diode. As described above, due to the charge stored in the stray capacitance, a current flows to the ignition plug immediately after generation of spark discharge. The current generated at that time is a high-frequency current. Accordingly, the high-frequency current from the stray capacitance of a portion of the first power supply side line located on the upstream side (first power supply side) of the inductor attenuates when it passes through the inductor. Namely, the charge stored in the stray capacitance on the upstream side of the inductor is prevented from becoming a noise generation source. Also, since the inductor is disposed on the ignition plug side of the first diode, the stray capacitance of a portion of the first power supply side line located on the ignition plug side of the inductor can be reduced. Thus, the capacitor stored in the stray capacitance (in other words, a charge which may serve as a noise generation source) can be reduced sufficiently. As a result, it becomes possible to decrease the current flowing to the ignition plug, due to the stray capacitance of the first power supply side line, immediately after generation of spark discharge, whereby noise can be suppressed effectively.

Notably, the inductor can be readily made compact as compared with a diode which satisfies requirements such as reverse withstanding voltage. Therefore, disposing the inductor in an existing plug hole is not so difficult. When the inductor is disposed in the plug hole, an action and an effect similar to those achieved by Configuration 7 to be described later can be attained. Namely, the stray capacitance of the portion of the first power supply side line located on the ignition plug side of the inductor can be decreased further, whereby the noise suppression effect can be enhanced further.

Also, according to the above-described configuration 1, the inductor is composed of a wound metal wire, and is disposed around at least a portion of the second power supply side line. Accordingly, the size (diameter) of the apparatus can be reduced, and the inductor can be readily disposed in the plug hole.

Configuration 2. A connection device of the present configuration is characterized in that in configuration 1 mentioned above, the second power supply side line includes a resistor connected in series.

According to the above-described configuration 2, due to presence of the resistor, it becomes possible to restrain the charge stored in a portion of the second power supply side line located on the upstream side (second power supply side) of the resistor from flowing to the ignition plug. Thus, the noise suppression effect can be enhanced further.

Notably, in order to supply electric power from the first power supply to the ignition plug more reliably, it is preferred that the resistor be disposed on the second power supply side of the connection point between the two power supply side lines.

Also, it is preferred that at least a portion of the resistor be disposed inside the inductor. In this case, the energization path between the ignition plug and the resistor can be shortened more, whereby the charge stored in the energization path can be reduced further. Accordingly, the noise suppression effect can be enhanced further. Also, since the resistor is disposed inside the inductor, the size of the apparatus can be reduced further.

Configuration 3. A connection device of the present configuration is characterized in that in configuration 1 or 2 mentioned above, a core member for increasing the inductance of the inductor is disposed inside the inductor.

According to the above-described configuration 3, since the core member is disposed inside the inductor, the inductance of the inductor can be increased. Accordingly, the inductor can exhibit a current attenuation effect more reliably, to thereby enhance the noise suppression effect further.

Notably, in order to increase the inductance of the inductor more reliably, preferably, the core member is formed of a material having a relatively large relative permeability (e.g., 100 or greater).

Configuration 4. A connection device of the present configuration is characterized in that in configuration 3 mentioned above, at least a portion of the core member is interposed in the second power supply side line.

According to the above-described configuration 4, since the core member is interposed in the second power supply side line, the size of the apparatus can be reduced as compared with the case where a core member is provided separately from the second power supply side line.

Configuration 5. A connection device of the present configuration is characterized in that in configuration 3 or 4 mentioned above, the second power supply side line includes a resistor connected in series; and at least a portion of the core member is the resistor.

As in the above-described configuration 5, the resistance of the core member may be set to a predetermined value or greater (e.g., 1Ω or greater) such that the core member functions as a resistor. In this case, the size of the apparatus and production cost can be reduced as compared with the case where a separate resistor is provided in the second power supply side line.

Configuration 6. A connection device of the present configuration is characterized in that in any of configurations 3 to 5 mentioned above, the second power supply side line includes a resistor connected in series; and the core member is disposed between the resistor and the second power supply.

According to the above-described configuration 6, the core member is disposed in the second power supply side line such that the core member is located on the second power supply side of the resistor (in other words, the resistor is disposed on the ignition plug side of the core member). Accordingly, the energization path between the ignition plug and the resistor can be shortened further. As a result, the charge stored in the energization path can be reduced further, whereby the noise suppression effect can be enhanced further.

Configuration 7. A connection device of the present configuration is characterized in that in any of configurations 1 to 6 mentioned above, a combustion apparatus to which the ignition plug is attached has a cylindrical plug hole into which the ignition plug is inserted; and at least a portion of the inductor is disposed in the plug hole.

According to the above-described configuration 7, the stray capacitance of the portion of the first power supply side line located on the ignition plug side of the inductor can be decreased further. As a result, it becomes possible to further decrease the current flowing to the ignition plug, due to the stray capacitance of the first power supply side line, immediately after generation of spark discharge, whereby the noise suppression effect can be enhanced further.

Configuration 8. A connection device of the present configuration is characterized in that in configuration 7 mentioned above, the plug hole has a cylindrical wall which defines the plug hole; and a core member for increasing the inductance of the inductor is disposed between the cylindrical wall and the second power supply side line.

According to the above-described configuration 8, the inductance of the inductor can be increased. Therefore, the inductor can exhibit a current attenuation effect more effectively. As a result, the noise suppression effect can be enhanced further.

Configuration 9. A connection device of the present configuration is characterized in that in any of configurations 1 to 8 mentioned above, the second power supply side line includes a resistor connected in series; and the sum of a length L1 of a path for establishing electrical connection between the inductor and the ignition plug and a length L2 of a path for establishing electrical connection between the resistor and the ignition plug is 5.0 cm or less.

According to the above-described configuration 9, the length (L1+L2) of energization paths which may store charges which cause generation of noise is set to 5.0 cm or less. Accordingly, the charges stored in the energization paths can be reduced sufficiently, whereby generation of noise can be suppressed more effectively.

Configuration 10. A connection device of the present configuration is characterized in that in any of configurations 1 to 9 mentioned above, the inductor has a resistance of 1Ω or less.

According to the above-described configuration 10, loss of the electric power supplied from the first power supply to the ignition plug can be reduced sufficiently.

Configuration 11. A connection device of the present configuration is characterized in that in any of configurations 1 to 10 mentioned above, the second power supply side line includes a second diode which prevents a current inflow from the first power supply into the second power supply or a current inflow from the second power supply into the first power supply.

According to the above-described configuration 11, a current inflow from the first power supply into the second power supply or a current inflow from the second power supply into the first power supply can be prevented. Therefore, electric power can be supplied from the first or second power supply to the ignition plug more reliably.

Configuration 12. A connection device of the present configuration is characterized in that in any of configurations 1 to 11 mentioned above, a combustion apparatus to which the ignition plug is attached has a cylindrical plug hole into which the ignition plug is inserted; and at least a portion of the first diode is disposed outside the plug hole.

According to the above-described configuration 12, at least a portion of the first diode is disposed outside the plug hole. Therefore, no limitation is imposed on the size of a diode which can be used as the first diode. In other word, a relatively large diode which has a proper reverse withstanding voltage and a proper current capacity can be used as the first diode.

Also, since the first diode is disposed outside the plug hole, breakage of the first diode due to heat generation of the combustion apparatus can be prevented more reliably.

Configuration 13. An ignition apparatus of the present configuration is an ignition apparatus used for an ignition plug including a center electrode, a ground electrode, and a gap formed between the two electrodes, the ignition apparatus being characterized by comprising:

a connection device described in any of configurations 1 to 12 mentioned above; and a capacitance section which is electrically connected to the first power supply side line and is provided parallel to the ignition plug, and the capacitance section including a capacitance.

According to the above-described configuration 13, actions and effects similar to those achieved by the above-described configuration 1, etc. are attained.

Configuration 14. An ignition apparatus of the present configuration is an ignition apparatus used for an ignition plug including a center electrode, a ground electrode, and a gap formed between the two electrodes, the ignition apparatus being characterized by comprising:

a connection device described in any of configurations 1 to 12 mentioned above;

a first power supply which is electrically connected to the first power supply side line and which supplies electric power to the gap; and a second power supply which is electrically connected to the second power supply side line and which apples a voltage to the gap.

According to the above-described configuration 14, actions and effects similar to those achieved by the above-described configuration 1, etc. are attained.

Configuration 15. An ignition system of the present configuration is characterized by comprising:

an ignition apparatus described in configuration 13 or 14 mentioned above; and an ignition plug to which electric power is supplied from the ignition apparatus.

According to the above-described configuration 15, actions and effects similar to those achieved by the above-described configuration 1, etc. are attained.

MODES FOR CARRYING OUT THE INVENTION

Figure 1:
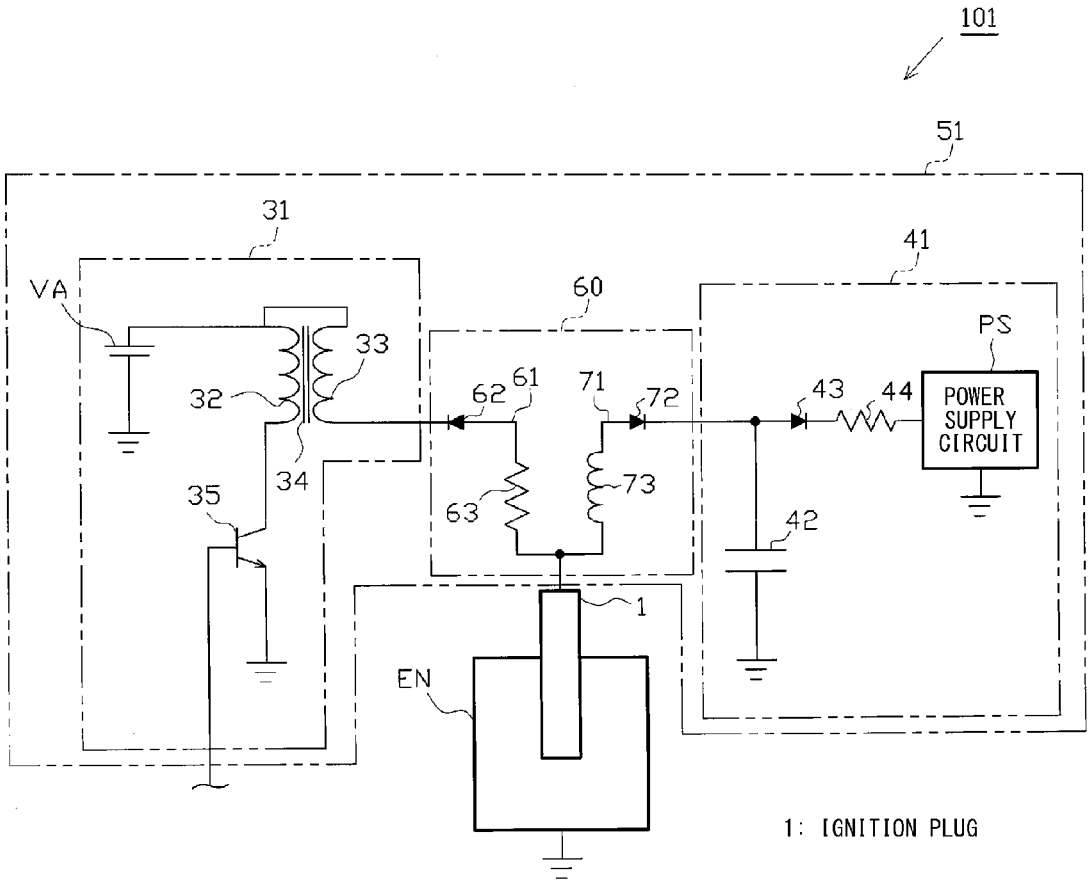
FIG. 1 Block diagram schematically showing the configuration of an ignition system.

One embodiment will now be described with reference to the drawings. FIG. 1 is a block diagram schematically showing the configuration of an ignition system 101 which includes an ignition plug 1 and an ignition apparatus 51. The ignition apparatus 51 includes a first power supply 41, a second power supply 31, and a connection device 60 which electrically connects the two power supplies 31 and 41 to the ignition plug 1. In FIG. 1, only one ignition plug 1 is illustrated. However, an internal combustion engine EN, which is a combustion apparatus, has a plurality of cylinders, and the ignition plug 1 is provided for each of the cylinders. The first power supply 41 and the second power supply 31 are individually provided for each ignition plug 1.

Before describing the ignition system 101, the structure of the ignition plug 1 will be described briefly.

Figure 2:
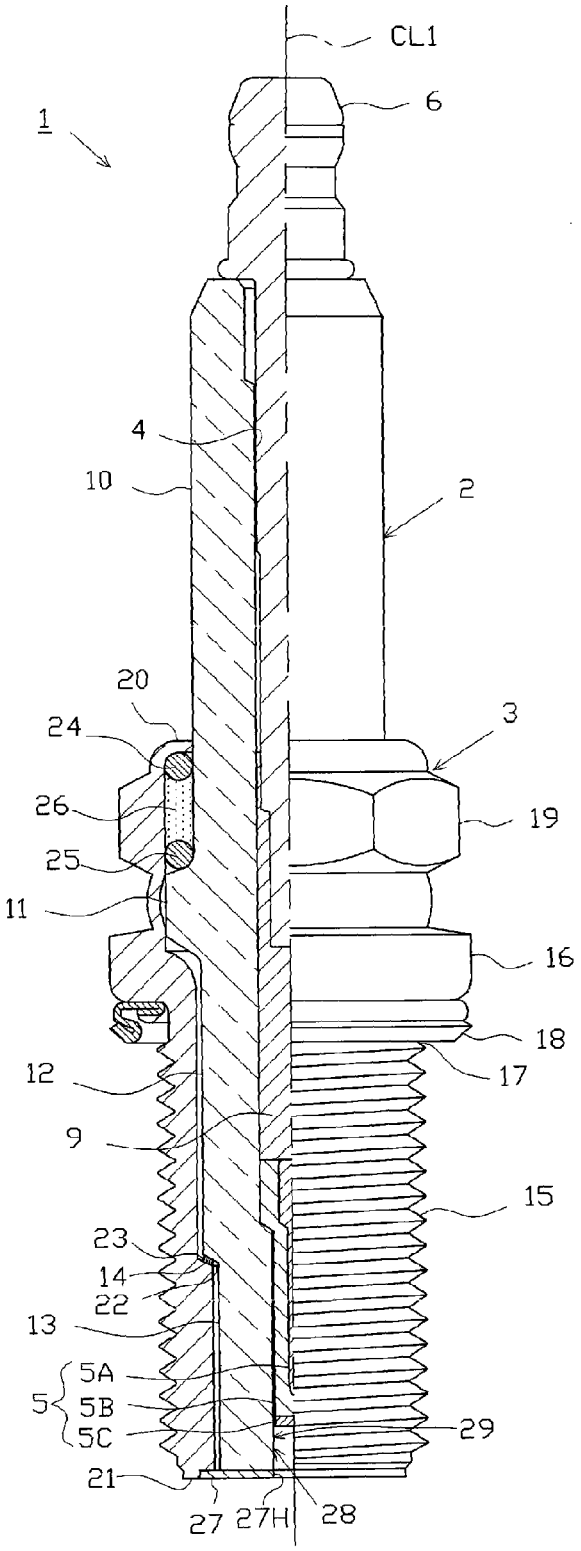
FIG. 2 Partially cutaway front view showing the structure of an ignition plug.

FIG. 2 is a partially cutaway front view showing the ignition plug 1. In the following description, the direction of an axis CL1 of the ignition plug 1 in FIG. 2 is referred to as the vertical direction, and the lower side of FIG. 2 is referred to as the front side of the ignition plug 1, and the upper side as the rear side of the ignition plug 1.

The ignition plug 1 includes a tubular insulator 2, and a tubular metallic shell 3, which holds the insulator 2.

The insulator 2 is formed from alumina or the like by firing, as well known in the art. The insulator 2 includes a rear trunk portion 10, a large-diameter portion 11, an intermediate trunk portion 12, and a leg portion 13, which portions define the outward shape of the insulator 2. The rear trunk portion 10 is formed on the rear side. The large-diameter portion 11 is located frontward of the rear trunk portion 10 and projects radially outward. The intermediate trunk portion 12 is located frontward of the large-diameter portion 11 and is smaller in diameter than the large-diameter portion 11. The leg portion 13 is located frontward of the intermediate trunk portion 12 and is smaller in diameter than the intermediate trunk portion 12. The large-diameter portion 11, the intermediate trunk portion 12, and the leg portion 13 of the insulator 2 are accommodated in the metallic shell 3. A tapered, stepped portion 14 is formed at a connection portion between the intermediate trunk portion 12 and the leg portion 13. The insulator 2 is seated on the metallic shell 3 via the stepped portion 14.

The insulator 2 has an axial hole 4 extending therethrough along the axis CL1. A center electrode 5 is fixedly inserted into a front end portion of the axial hole 4. The center electrode 5 includes an inner layer 5A and an outer layer 5B. The inner layer 5A is formed of copper, a copper alloy, or the like which is excellent in thermal conductivity. The outer layer 5B is formed of an Ni alloy (e.g., Inconel (trademark) 600 or 601, or the like) which contains nickel (Ni) as a main component. The center electrode 5 assumes a rodlike (circular columnar) shape as a whole, and its front end is disposed rearward of the front end surface of the insulator 2 with respect to the direction of the axis CL1. A portion of the center electrode 5, which portion extends from the front end of the center electrode 5 toward the rear side with respect to the direction of the axis CL1 and which has an axial length of at least 0.3 mm is constituted by an electrode tip 5C which is formed of tungsten (W), iridium (Ir), platinum (Pt), nickel (Ni), or an alloy which contains at least one of these metals as a main component.

A terminal electrode 6 is fixedly inserted into the rear side of the axial hole 4 and projects from the rear end of the insulator 2.

A circular columnar glass seal layer 9 is disposed between the center electrode 5 and the terminal electrode 6. The center electrode 5 and the terminal electrode 6 are electrically connected together through the glass seal layer 9, and the center electrode 5 and the terminal electrode 6 are fixed to the insulator 2 by the glass seal layer 9.

In some cases, a resistor for noise suppression is disposed between the center electrode 5 and the terminal electrode 6. However, the ignition plug 1 of the present embodiment is configured such that no resistor is disposed between the center electrode 5 and the terminal electrode 6. This configuration allows more reliably supply of electric power from the first power supply 41 to the ignition plug 1. Therefore, the resistance between the rear end of the terminal electrode 6 and the front end of the center electrode 5 is very small (e.g., 1Ω or less).

The metallic shell 3 is formed from a low-carbon steel or the like and is formed into a tubular shape. The metallic shell 3 has a threaded portion (externally threaded portion) 15 on its outer circumferential surface, and the threaded portion 15 is used to mount the ignition plug 1 to a mount hole of a combustion apparatus (e.g., an internal combustion engine, a fuel cell reformer, or the like). The metallic shell 3 has a seat portion 16 formed rearward of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 provided at its rear end portion and adapted to hold the insulator 2. In addition, the metallic shell 3 has an annular engagement portion 21 which is formed along the outer periphery of the front end portion of the metallic shell 3 and projects toward the front side with respect to the direction of the axis CL1. A ground electrode 27 to be described later is joined to the engagement portion 21.

The metallic shell 3 has a tapered stepped portion 22 provided on the inner circumferential surface thereof and adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 22 of the metallic shell 3, a rear-end opening portion of the metallic shell 3 is crimped radially inward; i.e., the crimp portion 20 is formed, whereby the insulator 2 is fixed to the metallic shell 3. An annular sheet packing 23 is interposed between the stepped portions 14 of the insulator 2 and the stepped portion 22 of the metallic shell 3. This retains gastightness of a combustion chamber and prevents leakage of a fuel gas to the exterior of the ignition plug 1 through the clearance between the inner circumferential surface of the metallic shell 3 and the leg portion 13 of the insulator 2.

In order to ensure gastightness which is established by crimping, annular ring members 24 and 25 intervene between the metallic shell 3 and the insulator 2 in a region near the rear end of the metallic shell 3, and the space between the ring members 24 and 25 is filled with powder of talc 26. That is, the metallic shell 3 holds the insulator 2 via the sheet packing 23, the ring members 24 and 25, and the talc 26.

A disc-shaped ground electrode 27 is joined to the front end portion of the metallic shell 3 such that the ground electrode 27 is located frontward of the front end of the insulator 2 with respect to the direction of the axis CL1. In a state in which the ground electrode 27 is engaged with the engagement portion 21 of the metallic shell 3, the outer periphery of the ground electrode 27 is welded to the engagement portion 21, whereby the ground electrode 27 is joined to the metallic shell 3. In the present embodiment, the ground electrode 27 is formed of W, Ir, Pt, Ni, or an alloy which contains at least one of these metals as a main component.

The ground electrode 27 has a through-hole 27H which is formed at the center thereof and which penetrates the ground electrode 27 in the thickness direction thereof. A cavity 28 which is a circular columnar space formed by the inner circumferential surface of the axial hole 4 and the front end surface of the center electrode 5 and is open toward the front side communicates with the outside of the ignition plug 1 through the through-hole 27H.

In the above-described ignition plug 1, a high voltage is applied to the gap 29 formed between the center electrode 5 and the ground electrode 27 so as to generate spark discharge, and electric power is then supplied to the gap 29 so as to change the discharge state to thereby generate plasma in the cavity 28. The generated plasma is jetted from the through-hole 27H. Next, there will be described the configuration of the second power supply 31 for applying a high voltage to the gap 29 of the ignition plug 1 and the configuration of the first power supply 41 for supplying electric power to the gap 29. Notably, the two power supplies 31 and 41 are connected to the ignition plug 1 through the connection device 60, and the connection device 60 includes a first power supply side line 71 and a second power supply side line 61.

As shown in FIG. 1, the second power supply 31 is electrically connected to the ignition plug 1 through the second power supply side line 61, and includes a primary coil 32, a secondary coil 33, a core 34, and an igniter 35.

The primary coil 32 is wound around the core 34. One end of the primary coil 32 is connected to a battery VA for supplying electric power, and the other end of the primary coil 32 is connected to the igniter 35. The secondary coil 33 is also wound around the core 34. One end of the secondary coil 33 is connected to a line between the primary coil 32 and the battery VA, and the other end of the secondary coil 33 is connected to the terminal electrode 6 of the ignition plug 1 through the second power supply side line 61.

The igniter 35 is formed of a predetermined transistor, and performs switching so as to permit and prohibit the supply of electric power from the battery VA to the primary coil 32 in accordance with an energization signal sent from an unillustrated ECU (electronic control unit). When a high voltage is to be applied to the ignition plug 1, a current is supplied from the battery VA to the primary coil 32 so as to form a magnetic field around the core 34, and the supply of electricity from the battery VA to the primary coil 32 is stopped by changing the energization signal from the ECU from an ON level to an OFF level. As a result of stoppage of the supply of electricity, the magnetic field of the core 34 changes, and the secondary coil 33 generates a high voltage (e.g., 5 kV to 30 kV) of negative polarity. This high voltage is applied to the ignition plug 1 (the terminal electrode 6), whereby a spark discharge can be generated at the gap 29.

The first power supply 41 is electrically connected to the ignition plug 1 through the first power supply side line 71, and includes a power supply circuit PS and a capacitor 42 (corresponding to the "capacitance section" of the present invention).

The power supply circuit PS can generate a high voltage (e.g., 500 V to 1000 V) of negative polarity, and is electrically connected to the ignition plug 1 and the capacitor 42 through a third diode 43 and a second resistor 44. The capacitor 42 is electrically connected to the first power supply side line 71. One end of the capacitor 42 is grounded, and the other end of the capacitor 42 is connected to the power supply circuit PS. The capacitor 42 is connected in parallel to the ignition plug 1, and is charged by the power supply circuit PS. When a spark discharge is generated at the gap 29 and dielectric breakdown occurs between the two electrodes 5 and 27, the electrical energy accumulated in the capacitor 42 is supplied to the ignition plug 1 through the first power supply side line 71, whereby plasma is generated.

Since a first diode 72 and an inductor 73 are disposed in the first power supply side line 71, the electrical energy accumulated in the capacitor 42 is supplied to the ignition plug 1 through the first diode 72 and the inductor 73.

The first diode 72 prevents a current inflow from the second power supply 31 into the first power supply 41 so as to enable the ignition plug 1 to generate spark discharge more reliably. In the present embodiment, in consideration that a high voltage is output from the second power supply 31 (the secondary coil 33) and relatively large electric power is supplied from the first power supply 41 to the ignition plug 1, a diode having a sufficiently high reverse withstanding voltage and a sufficiently large current capacity is used as the first diode 72. Therefore, the first diode 72 is relatively large in size. In the present embodiment, only one first diode 72 is provided. However, a plurality of first diodes may be provided in series.

The inductor 73 prevents instantaneous supply of electrical energy from the capacitor 42 to the ignition plug 1, to thereby continue the jetting of the plasma from the cavity 28 over a certain period of time. Notably, as a result of increasing the time over which the plasma jet continues, the amount of heat given to a gas mixture or the like increases, whereby ignition performance can be enhanced.

The inductor 73 is provided between the first diode 72 and the ignition plug 1 (notably, the position where the inductor 73 is disposed will be described in detail later).

A second diode 62 and a first resistor 63 (corresponding to the resistor of the present invention) are disposed in the second power supply side line 61.

The second diode 62 prevents a current inflow from the first power supply 41 into the second power supply 31, to thereby prevent, for example, leakage of current at the time of charging of the capacitor 42. Notably, the second diode 62 is not required to have a reverse withstanding voltage and a current capacity as large as those of the first diode 72. As a result, a diode which is smaller in size than the first diode 72 is used as the second diode 62.

The first resistor 63 is provided between the second diode 62 and the ignition plug 1. The first resistor 63 prevents the charge stored in a stray capacitance of a portion of the second power supply side line 61, the portion being located between the second power supply 31 and the first resistor 63, from flowing to the ignition plug 1 as a result of generation of spark discharge, whereby generation of noise is suppressed. Notably, in the present embodiment, in order to more reliably supply electric power from the first power supply 41 to the ignition plug 1, the first resistor 63 is disposed between the second power supply 31 and a connection point where the two power supply side lines 61 and 71 are connected together.

In the present embodiment, the above-described inductor 73, first resistor 63, and second diode 62 are disposed in a circular columnar plug connector 81 which is connected to the ignition plug 1 (namely, the connection device 60 has the plug connector 81). Next, the structure of the plug connector 81, and the positions where the inductor 73, the first resistor 63, etc. are disposed will be described.

Figure 3:
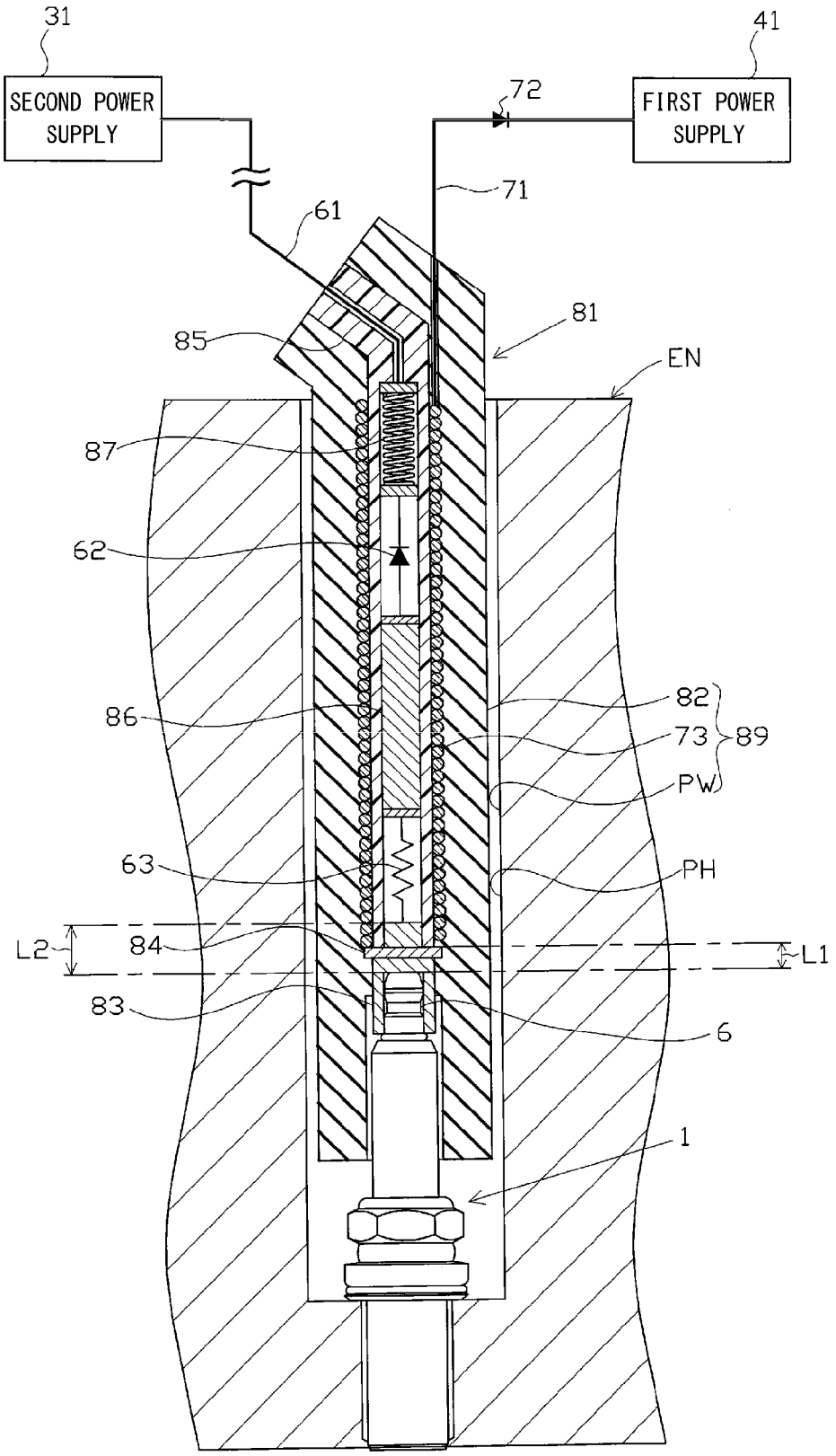
FIG. 3 Schematic view showing the structures of a plug connector, etc.

As shown in FIG. 3, the greater part of the plug connector 81 is disposed in a cylindrical plug hole PH of the internal combustion engine EN into which the ignition plug 1 is inserted for mounting, and includes a tubular outer sleeve 82 formed of an insulating material (e.g., insulating rubber such as silicone rubber, fluoro rubber, or acrylic rubber). The outer sleeve 82 is configured such that the ignition plug 1 is inserted into one end of the outer sleeve 82. A connector metal fitting 83 having the form of a closed-end tube is provided inside the outer sleeve 82. When the plug connector 81 is connected to the ignition plug 1, the terminal electrode 6 is inserted into the connector metal fitting 83. The connector metal fitting 83 provides a connection point (merging point) between the second power supply side line 61 and the first power supply side line 71. The second power supply side line 61 is connected to the end of the connector metal fitting 83 opposite the ignition plug 1, and the first power supply side line 71 is connected to an annular washer 84 which is in contact with the outer circumference of the connector metal fitting 83.

A tubular insulating case 85 formed of an insulating material (e.g., insulating resin such as epoxy resin) is disposed around at least a portion of the second power supply side line 61 connected to the connector metal fitting 83. The above-mentioned inductor 73 is disposed around the insulating case 85. Namely, the inductor 73 is disposed around at least a portion of the second power supply side line 61, with the insulating case 85 interposed therebetween, in a state in which the inductor 73 is separated from the second power supply side line 61.

The inductor 73 is formed by winding an electrically conductive metal wire (e.g., copper wire, iron wire, or the like) coated with insulating film. At least a portion (substantially the entirety in the present embodiment) of the inductor 73 is disposed within the plug hole PH. The end of the inductor 73 on the side toward the ignition plug 1 is in contact with the washer 84, whereby the length of a path which electrically connects the connector metal fitting 83 (the front end of the center electrode 5) and the inductor 73 together can be made sufficiently small. In the present embodiment, the length of the electrically conductive path which establishes connection between the rear end of the terminal electrode 6 and the end of the inductor 73 on the side toward the ignition plug 1 is rendered 10 cm or less (more preferably, 2 cm or less). As a result, the stray capacitance present between the inductor 73 and the front end of the center electrode 5 can be decreased, whereby noise can be reduced effectively. Notably, from the viewpoint of more reliably enhancing the noise reducing effect, it is preferred that the end of the inductor 73 on the ignition plug 1 side be rendered closer to the ignition plug 1, as compared with the end of the first resistor 63 on the ignition plug 1 side, as in the present embodiment.

In the present embodiment, the resistance of the inductor 73 is set to 1Ω or less.

The first resistor 63 of the second power supply side line 61 is disposed immediately upstream of the connector metal fitting 83, whereby the length of a path which electrically connects the connector metal fitting 83 (the front end of the center electrode 5) and the first resistor 63 together can be made sufficiently small. In the present embodiment, the length of the electrically conductive path which establishes connection between the rear end of the terminal electrode 6 and the end of the first resistor 63 on the side toward the ignition plug 1 is rendered 10 cm or less (more preferably, 3 cm or less). As a result, the distance between the first resistor 63 and the front end of the center electrode 5 (i.e., the stray capacitance present between the first resistor 63 and the front end of the center electrode 5) can be decreased. As a result, when the charge stored in the stray capacitance flows to the ignition plug 1 as a result of generation of spark discharge, the current flowing to the ignition plug 1 can be decreased, whereby noise can be reduced effectively.

A circular columnar core member 86 is interposed between the first resistor 63 and the second diode 62 such that the core member 86 is located between the first resistor 63 and the second power supply 31. The core member 86 is formed of a metallic material having a relatively large relative permeability (e.g., 100 or greater), and is disposed radially inward of the inductor 73. The inductance of the inductor 73 is increased by disposing the core member 86 inside the inductor 73, whereby the inductance of the inductor 73 is rendered equal to or greater than a predetermined value (e.g., 1 μH). Examples of the metallic material used for forming the core member include iron, cobalt, nickel, and an alloy which contains any of these metals as a main component. In the present embodiment, the outer diameter and the axial length of the core member 86 are rendered relatively large (e.g., the outer diameter is 4 mm or greater, and the axial length is 10 mm or greater), whereby the inductance of the inductor 73 can be increased more reliably.

A spring member 87 is disposed upstream of the first resistor 63, and the vibration resistance of the second power supply side line 61 is increased by the spring member 87.

At least a portion of the first resistor 63 (the entire first resistor 63 in the present embodiment) is disposed inside the inductor 73.

In the present embodiment, the sum (L1+L2) of the length L1 of the path which establishes electrical connection between the inductor 73 and the ignition plug 1 and the length L2 of the path which establishes electrical connection between the first resistor 63 and the ignition plug 1 is rendered equal to or less than 5.0 cm.

Notably, since the first diode 72 is relatively large in size as described above, the first diode 72 is disposed outside the plug hole PH.

A cylindrical wall PW which defines the plug hole PH, the inductor 73, and the outer sleeve 82 located therebetween cooperatively form a capacitor constituting section 89 (corresponding to the "capacitance section" of the present invention) which has a capacitance connected in parallel to the ignition plug 1. The capacitor constituting section 89 is connected in parallel to the ignition plug 1, and is electrically connected to the second power supply 31 at a position downstream of the first diode 72. In addition, the capacitance of the capacitor constituting section 89 is increased by disposing the entire inductor 73 in the plug hole PH. In the present embodiment, the capacitance of the capacitor constituting section 89 is set to a predetermined value (e.g., 1.0 pF) or greater. Notably, the "capacitance section" in the present invention may be any capacitor which is electrically connected to the first power supply side line 71 and is provided parallel to the ignition plug 1. In the present embodiment, both of the capacitor 42 and the capacitor constituting section 89 correspond to the "capacitance section."

As having been described in detail, according to the present embodiment, the inductor 73 is provided in the first power supply side line 71 which electrically connects the ignition plug 1 and the first power supply 41 together such that the inductor 73 is located on the ignition plug 1 side (downstream) of the first diode 72. Accordingly, when a high-frequency current flows from the stray capacitance of a portion of the first power supply side line 71 located on the upstream side (the side toward the first power supply 41) of the inductor 73, the high-frequency current attenuates when it flows through the inductor 73. That is, the charge stored in the stray capacitance on the upstream side of the inductor 73 is prevented from becoming a noise generation source. Also, the length of the electrically conductive path between the inductor 73 and the front end of the center electrode 5 is made sufficiently small by, for example, disposing the inductor 73 in the plug hole PH. Therefore, the stray capacitance of a portion of the first power supply side line 71 located between the inductor 73 and the ignition plug 1 can be decreased. Thus, the charge stored in the stray capacitance (in other words, the charge which may serve as a noise generation source) can be reduced sufficiently. As a result, the current flowing to the ignition plug 1 due to the stray capacitance of the first power supply side line 71 immediately after generation of spark discharge can be reduced, whereby noise can be suppressed effectively.

The inductor 73 is a wound metal wire, and is disposed to surround at least a portion of the second power supply side line 61. Accordingly, the size of the plug connector 81 can be reduced, and the inductor 73 can be readily disposed in the plug hole PH.

The core member 86 is disposed inside the inductor 73 so that the inductor 73 has a relatively large inductance. Accordingly, the inductor 73 can exhibit a current attenuation effect more reliably, to thereby enhance the noise suppression effect further.

Since the resistance of the inductor 73 is 1Ω or less, loss of the electric power supplied from the first power supply 41 to the ignition plug 1 can be reduced sufficiently.

Since the first diode 72 is disposed outside the plug hole PH, no limitation is imposed on the size of a diode which can be used as the first diode 72. In other words, a relatively large diode which has a proper reverse withstanding voltage and a proper current capacity can be used as the first diode 72. Also, since the first diode 72 is disposed outside the plug hole PH, breakage of the first diode 72 due to heat generation of the internal combustion engine EN can be prevented more reliably.

By disposing the first diode 72 outside the plug hole PH, the inner space of the plug connector 81 can be increased, and therefore the size of the core member 86 can be increased. As a result, the inductance of the inductor 73 can be increased more reliably.

Since a current inflow from the first power supply 41 into the second power supply 31 can be prevented by the second diode 62, electric power can be supplied from the first power supply 41 to the ignition plug 1 more reliably.

The core member 86 is disposed in the second power supply side line 61 to be located between the first resistor 63 and the second power supply 31 (in other words, the first resistor 63 is disposed between the core member 86 and the ignition plug 1). Accordingly, the energization path between the ignition plug 1 and the first resistor 63 can be shortened more reliably. As a result, the charge stored in the energization path can be reduced, whereby the noise suppression effect can be enhanced further.

Since at least a portion of the first resistor 63 is disposed inside the inductor 73, the energization path between the ignition plug 1 and the first resistor 63 can be shortened to a greater extent, whereby the charge stored in the energization path can be reduced. Accordingly, the noise suppression effect can be enhanced further. Also, since the first resistor 63 is disposed inside the inductor 73, the size of the apparatus can be reduced further.

In the present embodiment, the capacitor constituting section 89 can be charged by the output voltage from the second power supply 31, and when a spark discharge is generated, a large amount of charge can be supplied from the capacitor constituting section 89 to the gap 29. Accordingly, the capacitive discharge current flowing through the gap 29 can be increased remarkably, whereby the resistance of the gap 29 can be decreased more reliably. As a result, the electric power from the first power supply 41 can be supplied to the spark discharge (the gap 29) more reliably.

In the present embodiment, the capacitor constituting section 89 is formed by the cylindrical wall PW, the inductor 73, and the outer sleeve 82. Therefore, as compared with the case where a capacitor or the like is provided separately from the inductor 73, etc., production cost can be lowered, and the size of the apparatus can be reduced further.

In the present embodiment, since the capacitor constituting section 89 is formed by the cylindrical wall Pw, etc., the capacitor constituting section 89 can be disposed at a position very close to the ignition plug 1. Therefore, the energization path between the capacitor constituting section 89 and the ignition plug 1 can be made very short. That is, a portion which functions as an antenna for radiating noise when the charge stored in the capacitor constituting section 89 flows can be shortened. Accordingly, noise generated as a result of discharge of the charge stored in the capacitor constituting section 89 can be made very small, whereby the noise suppression effect can be enhanced further.

Notably, the ignition apparatus 51 of the present embodiment can be suitably used for an ignition plug in which the resistance between the rear end of the terminal electrode 6 and the front end of the center electrode 5 is low and which encounters difficulty in suppressing noise by itself.

Figure 4:
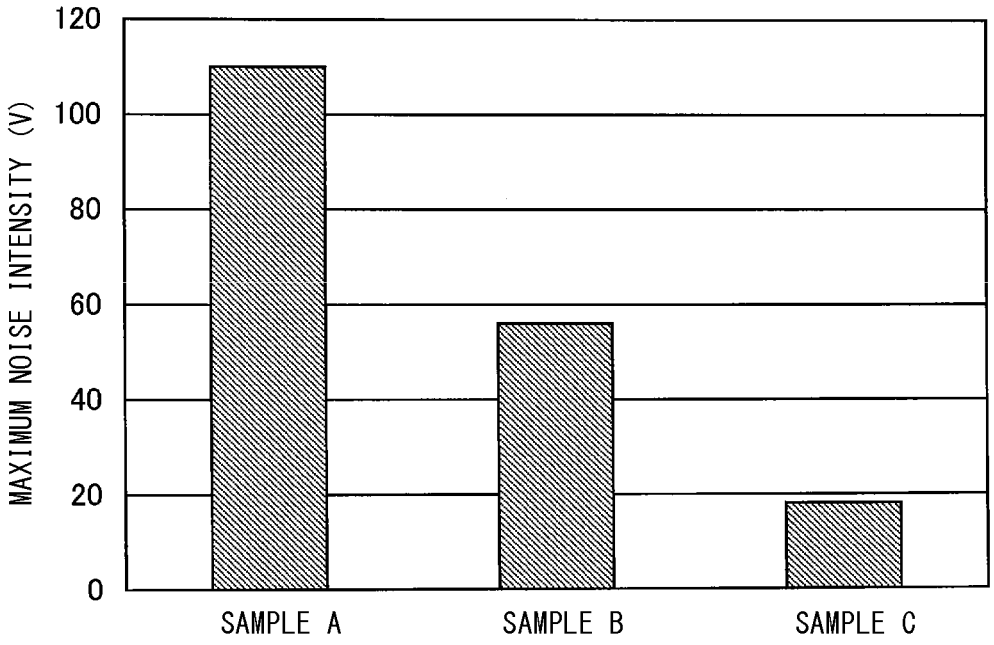
FIG. 4 Graph showing the results of a noise evaluation test.
Figure 5:
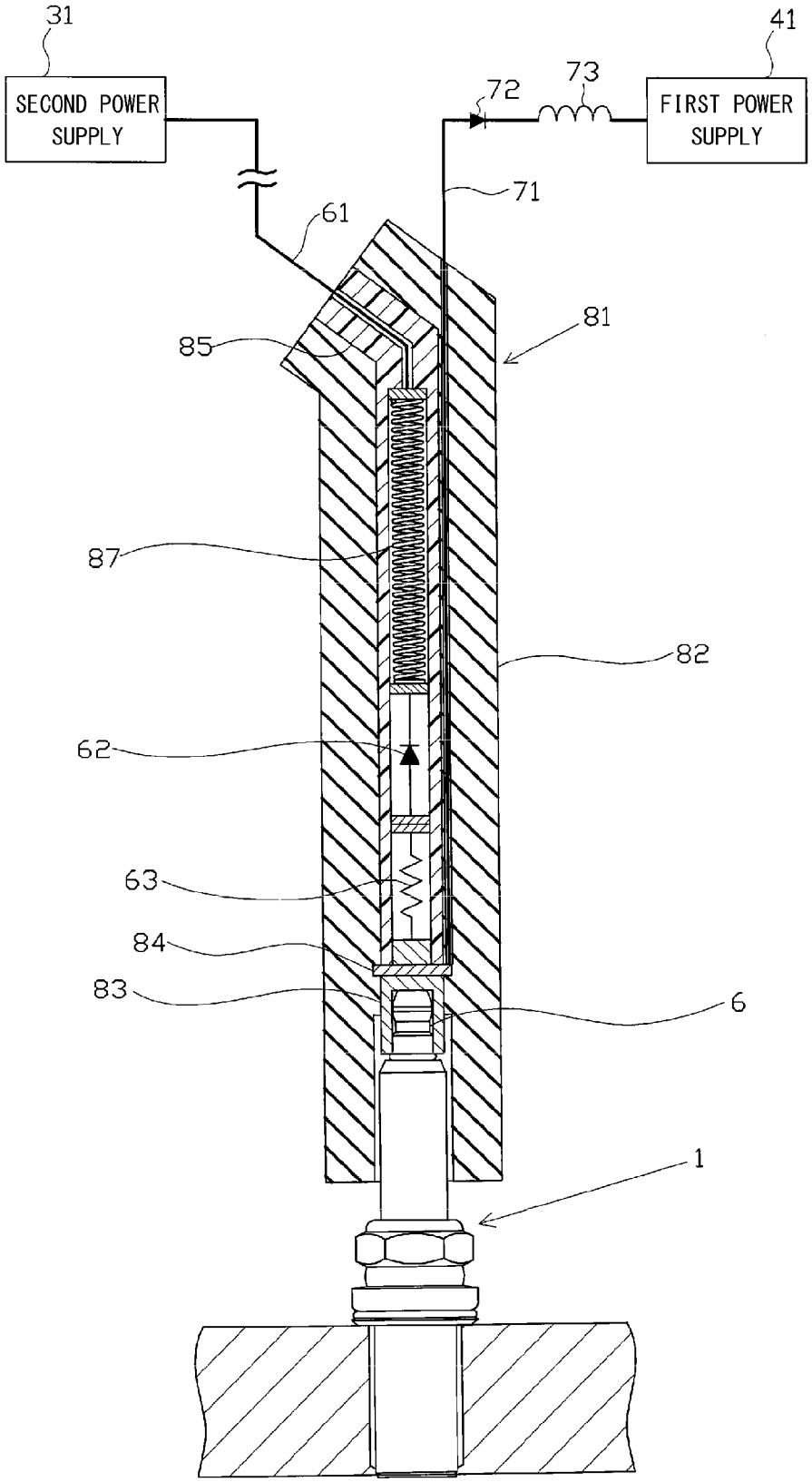
FIG. 5 Schematic view showing the structure of sample A (comparative example).
Figure 6:
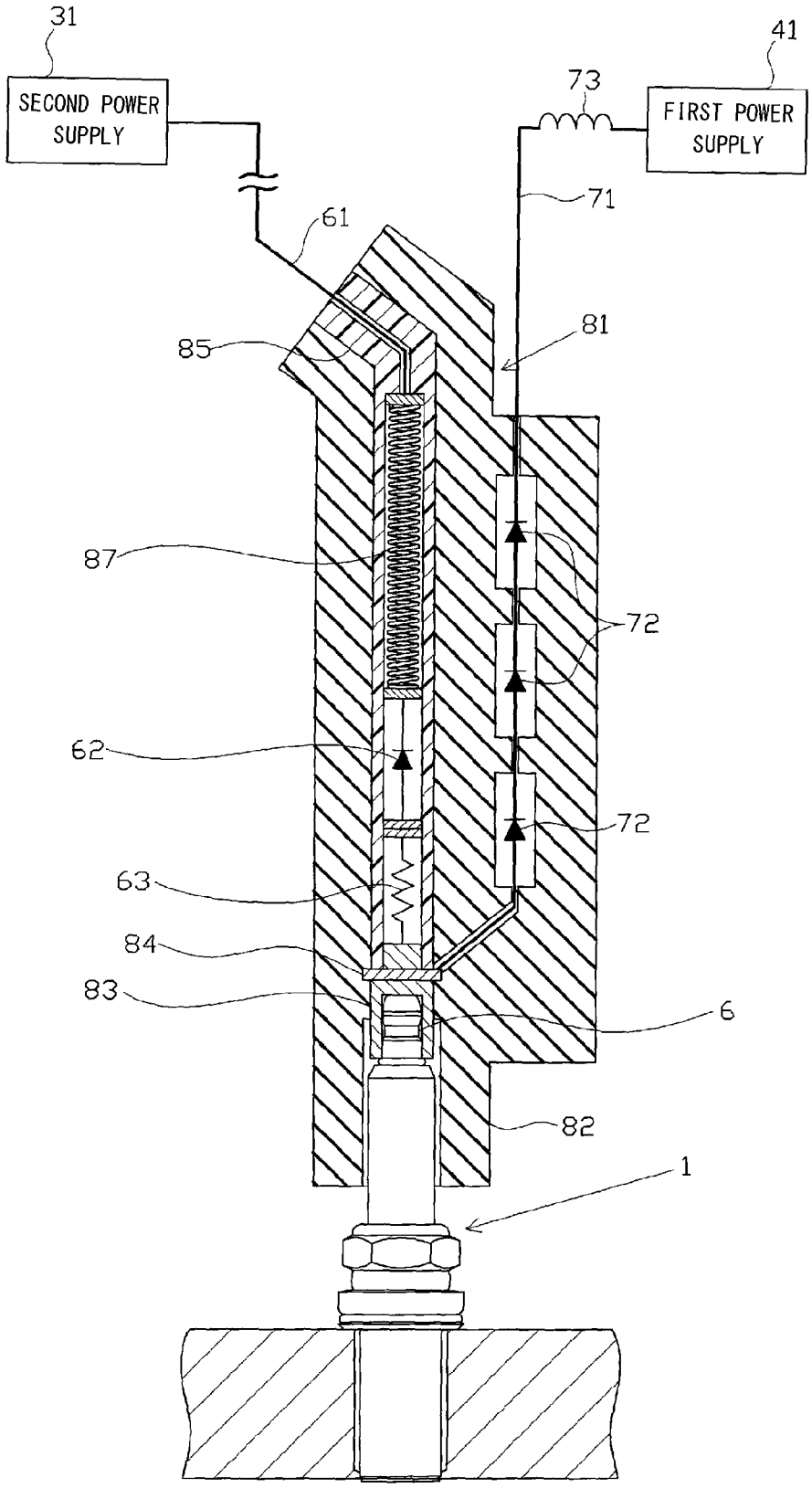
FIG. 6 Schematic view showing the structure of sample B (comparative example).

Next, in order to confirm the actions and effects achieved by the above-described embodiment, Samples A, B, and C of the ignition apparatus were manufactured, and a noise evaluation test was performed for each sample. The outline of the noise evaluation test is as follows. In a state in which a probe for receiving electromagnetic waves was disposed at a location which was a certain distance away of the first power supply, electric power was supplied to an ignition plug attached to a chamber imitating a combustion apparatus. The maximum voltage (maximum noise intensity) of electromagnetic waves (noise) generated upon supply of the electric power was measured for each sample. FIG. 4 shows the results of the test. Sample A (comparative example) was configured as shown in FIG. 5. Specifically, the inductor 73 was provided between the first diode 72 and the first power supply 41, and the path for establishing electrical connection between the first diode 72 and the connector metal fitting 83 was relatively long. Sample B (comparative example) was configured as shown in FIG. 6. Specifically, the inductor 73 was provided between a plurality of the first diodes 72 connected in series and the first power supply 41, and the path for establishing electrical connection between the first diodes 72 and the connector metal fitting 83 was relatively short. Sample C (Embodiment) was configured to have the same configuration as the ignition apparatus of the above-described embodiment (namely, the inductor 73 was provided between the first diode 72 and the ignition plug 1). Notably, in order to eliminate the influence of noise suppression by a plug hole, such a plug hole was not provided on the chamber.

As shown in FIG. 4, it was found that the maximum noise intensity of Sample C is very low and Sample C has an excellent noise suppression effect. Conceivably, this excellent noise suppression effect is obtained because the high-frequency current from the stray capacitance of a portion of the first power supply side line located upstream of the inductor attenuates when it passes through the inductor, and the stray capacitor of a portion of the first power supply side line located downstream of the inductor becomes sufficiently small as a result of disposition of the inductor between the first diode and the ignition plug.

The above-described test results reveal that in order to realize an excellent noise suppression effect, the inductor is preferably disposed in the first power supply side line to be located on the ignition plug side of the first diode (that is, between the first diode and the ignition plug).

Figure 7:
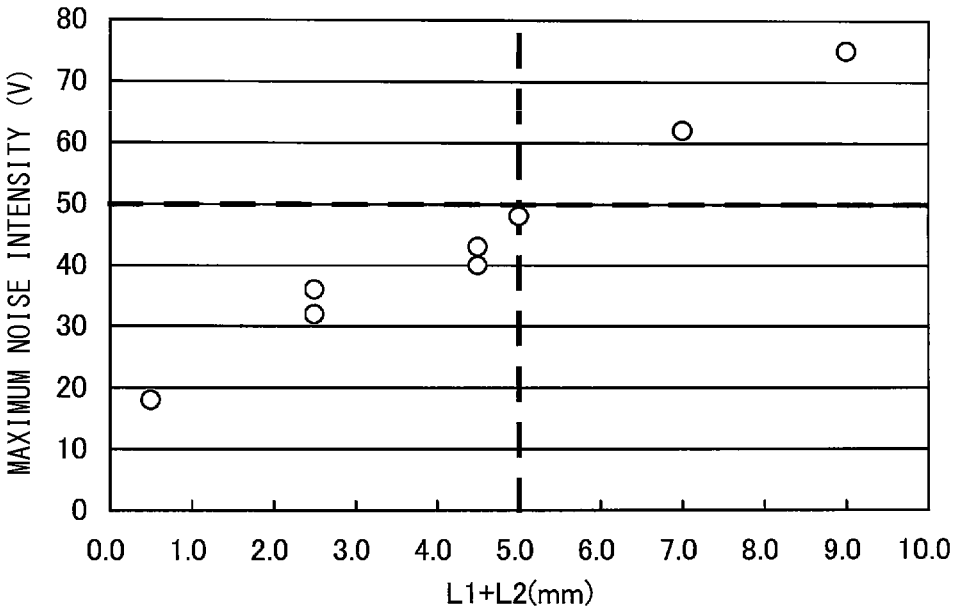
FIG. 7 Graph showing the results of a noise evaluation test performed for samples which differ in L1+L2.

Next, samples of the ignition apparatus which differed from one another in terms of the sum (L1+L2) of the length L1 (mm) of the path for establishing electrical connection between the inductor and the ignition plug and the length L2 (mm) of the path for establishing electrical connection between the first resistor and the ignition plug were manufactured, and the above-described noise evaluation test was carried out for each sample. FIG. 7 and Table 1 show the results of the test.

TABLE 1

| L1 (mm) | L2 (mm) | L1 + L2 (mm) | Noise intensity |
|---|---|---|---|
| 4.5 | 4.5 | 9.0 | 75 |
| 2.5 | 4.5 | 7.0 | 62 |
| 0.5 | 4.5 | 5.0 | 48 |
| 4.5 | 0.0 | 4.5 | 40 |
| 2.5 | 2.0 | 4.5 | 43 |
| 0.5 | 2.0 | 2.5 | 36 |
| 2.5 | 0.0 | 2.5 | 32 |
| 0.5 | 0.0 | 0.5 | 18 |

As shown in FIG. 7 and Table 1, it was found that when the sum (L1+L2) is set to 5.0 cm or less, the maximum noise intensity becomes sufficiently small (50 V or less), and an excellent noise suppression effect is attained.

The results of the above-described test reveal that in order to further enhance the noise suppression effect, the sum (L1+L2) of the length L1 (mm) of the path for establishing electrical connection between the inductor and the ignition plug and the length L2 (mm) of the path for establishing electrical connection between the first resistor and the ignition plug is preferably set to 5.0 cm or less.

Notably, the present invention is not limited to the above-described embodiment, but may be embodied, for example, as follows. Of course, applications and modifications other than those described below are also possible.

Figure 8:
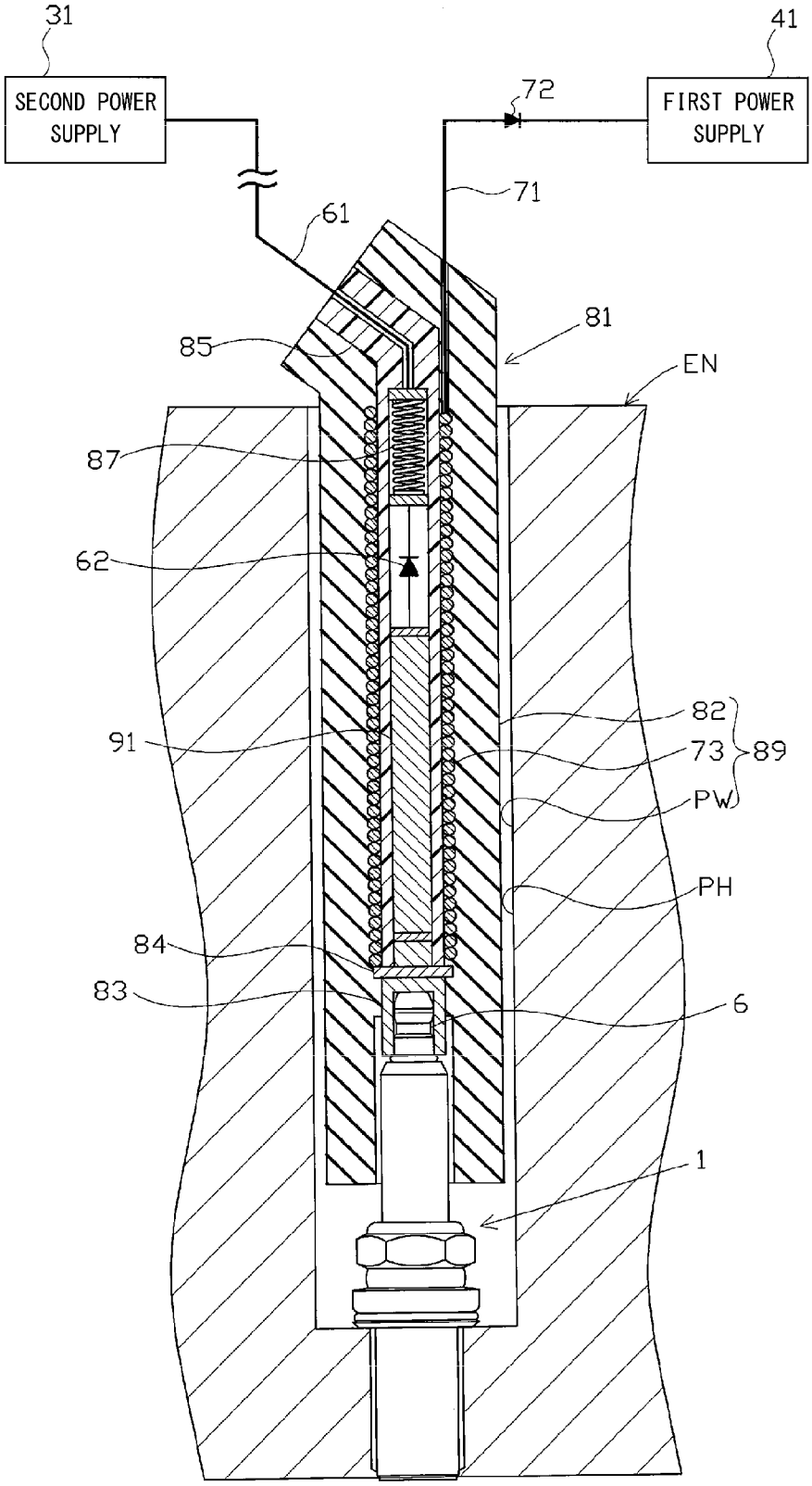
FIG. 8 Schematic view showing the structure of a second power supply side line according to another embodiment.

(a) In the above-described embodiment, the first resistor 63 and the core member 86 are provided in the second power supply side line 61. However, the embodiment may be modified as shown in FIG. 8. Specifically, only a core member 91 whose resistance is a predetermined value or greater (e.g., 1Ω or greater) may be provided in the second power supply side line 61 such that the core member 91 exhibits its original function of increasing the inductance of the inductor 73 and an additional function of suppressing noise by the resistor (the core member). In this case, the size of the apparatus can be reduced further, and the material cost can be lowered.

Figure 9:
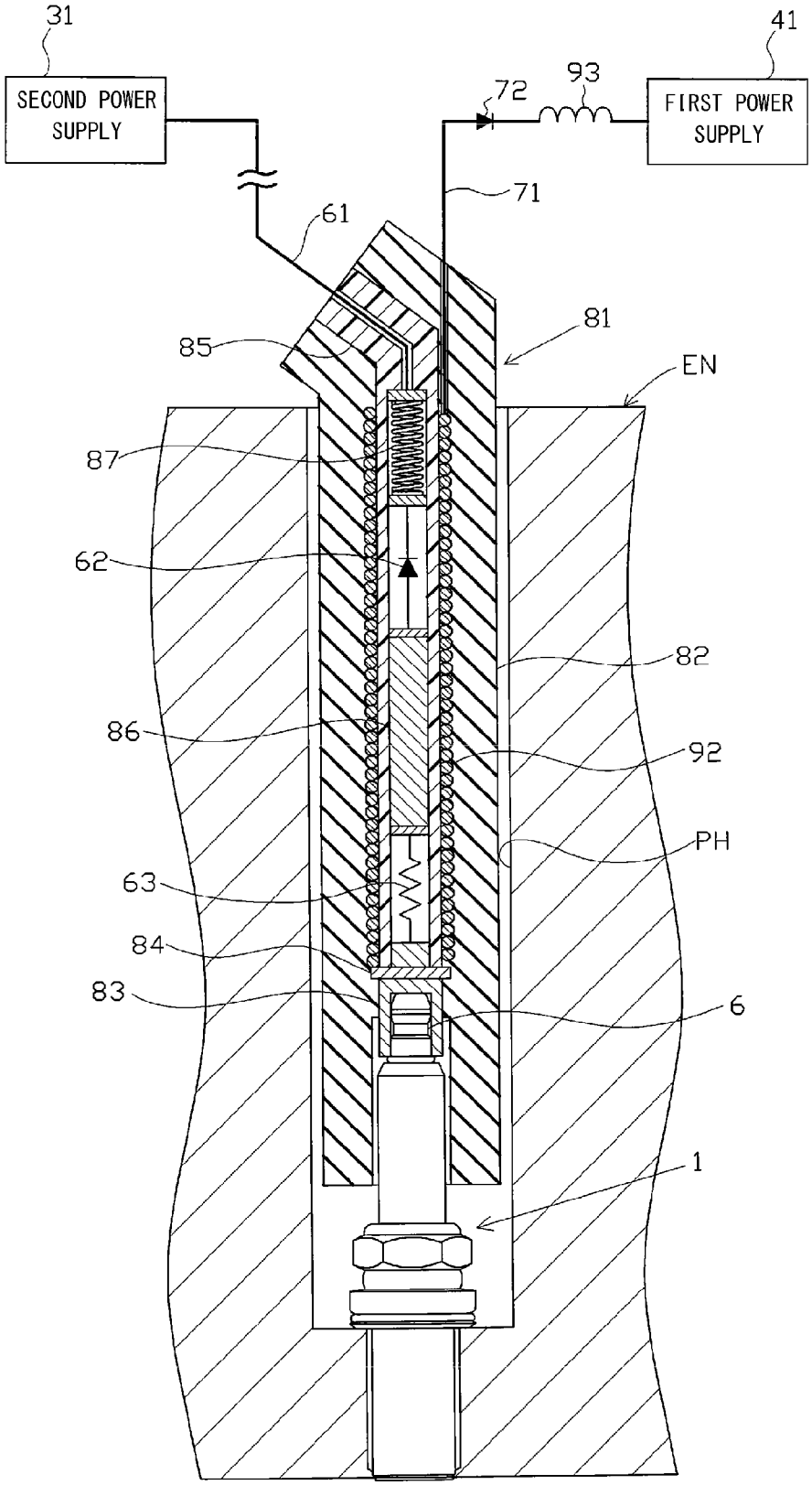
FIG. 9 Schematic view showing the structure of a first power supply side line according to another embodiment.

(b) In the above-described embodiment, the single inductor 73 is provided in the first power supply side line 71. However, as shown in FIG. 9, a plurality of inductors 92 and 93 may be provided in series in the first power supply side line 71 so as to further extend the period over which electric power is supplied from the first power supply 41 to the ignition plug 1. Notably, in this case, it is sufficient that at least one of the inductors 92 and 93 is provided between the first diode 72 and the ignition plug 1.

Figure 10:
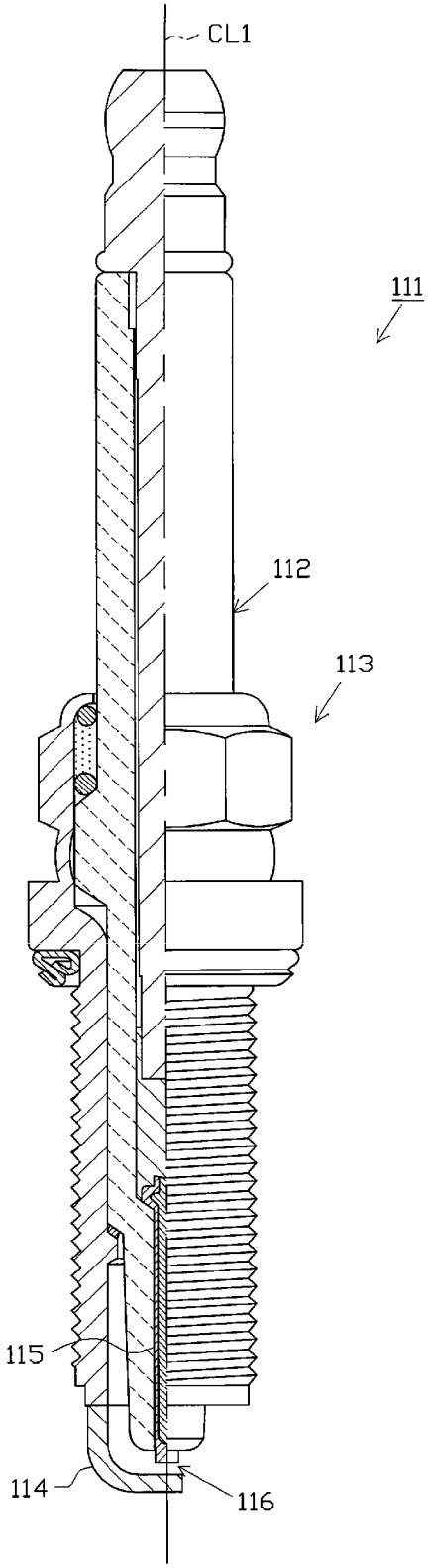
FIG. 10 Partially cutaway front view showing the structure of an ignition plug according to another embodiment.

(c) The structure of the ignition plug 1 of the above-described embodiment is a mere example, and no limitation is imposed on the structure of the ignition plug which can be used. Accordingly, an ignition plug 111 shown in FIG. 10 can be used. The ignition plug 111 includes a center electrode 115 whose front end projects from the front end of an insulator 112, a rod-shaped ground electrode 114 fixed to a front end portion of a metallic shell 113, and a gap 116 formed between the two electrodes 114 and 115.

Figure 11:
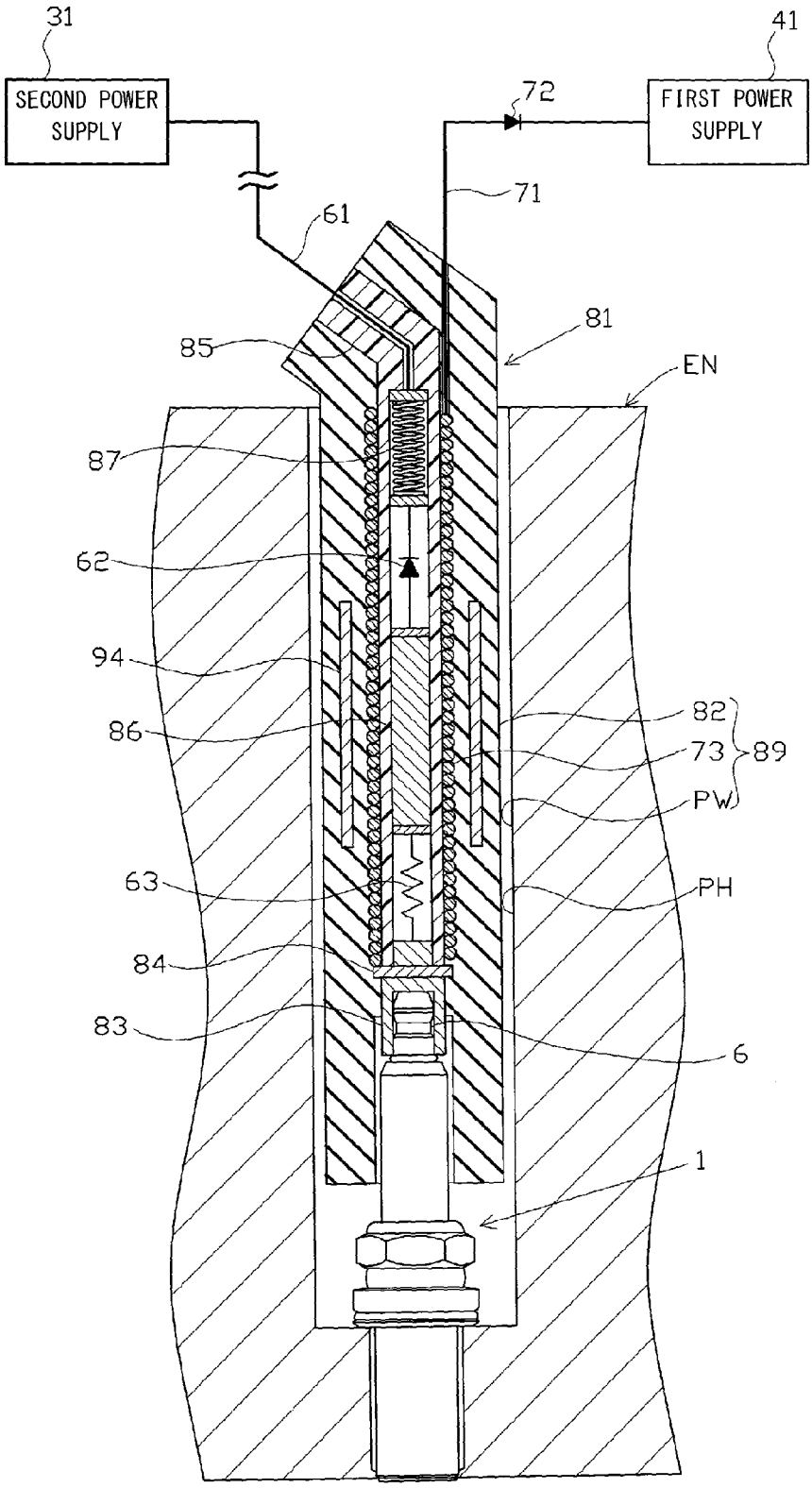
FIG. 11 Schematic view showing the structures of a plug connector, etc. according to another embodiment.

(d) In the above-described embodiment, the core member 86 is disposed inside the inductor 73. However, as shown in FIG. 11, a core member 94 for increasing the inductance of the inductor 73 may be disposed between the second power supply side line 61 and the metallic cylindrical wall PW which forms the plug hole PH. In this case, the inductance of the inductor 73 can be increased further, whereby the inductor 73 can exhibit a current attenuation effect more effectively. As a result, the noise suppression effect can be enhanced further. Notably, the core member 94 may be provided solely with the core member 86 being omitted.

(e) In the above-described embodiment, the power supply circuit PS generates a voltage of negative polarity. However, a power supply circuit which generates a voltage of positive polarity may be used as the power supply circuit PS. Also, a voltage of positive polarity may be applied from the second power supply 31 to the ignition plug 1. Namely, no limitation is imposed on the polarity of discharge at the gap 29.

(f) In the above-described embodiment, the inductor 73 is formed by winding an electrically conductive metal wire coated with insulating film. However, the structure of the inductor which can be used is not limited thereto. For example, a laminate-type inductor or the like may be used. Also, a wound electrically conductive metal embedded in an insulating material such as resin (e.g., the outer sleeve 82) may be used as an inductor.

(g) In the above-described embodiment, the inductor 73 is separated from the second power supply side line 61 with the insulating case 85 interposed therebetween. However, the inductor 73 may be separated from the second power supply side line 61 without interposing the insulating case 85 therebetween.

(h) In the above-described embodiment, the first diode 72 is disposed outside the plug hole PH. However, only a portion of the first diode 72 may be disposed outside the plug hole PH. Also, the first diode 72 may be disposed in the plug hole PH.

(i) In the above-described embodiment, the entire first resistor 63 is disposed inside the inductor 73. However, only a portion of the first resistor 63 may be disposed inside the inductor 73. Also, the first resistor 63 may be disposed outside the inductor 73.

(j) In the above-described embodiment, the second power supply 31 and the first power supply 41 are individually provided for each ignition plug 1. However, it is unnecessary to individually provide the second power supply 31 and the first power supply 41 for each ignition plug 1. Namely, electric power from the second power supply 31 or the first power supply 41 may be supplied to each ignition plug 1 and the capacitor 42 through a distributer.

(k) In the above-described embodiment, the inductor 73, the cylindrical wall PW, and the outer sleeve 82 cooperatively constitute the capacitor constituting section 89. However, in place of the capacitor constituting section 89 or in addition to the capacitor constituting section 89, there may be provided a capacitance section (e.g., a capacitor or the like) having a capacitance which is connected in parallel to the ignition plug 1 and is electrically connected to the second power supply 31 at a position downstream of the first diode 72.

DESCRIPTION OF SYMBOLS

1: ignition plug
5: center electrode
27: ground electrode

29: gap
31: second power supply
41: first power supply
42: capacitor (capacitance section)
51: ignition apparatus
60: connection device
61: second power supply side line
62: second diode
63: first resistor (resistor)
71: first power supply side line
72: first diode
73: inductor,
86: core member
89: capacitor constituting section (capacitance section)
101: ignition system
EN: combustion apparatus
PH: plug hole
PW: cylindrical wall

What is claimed is:

1. A connection device for connecting a first power supply and a second power supply to an ignition plug, comprising:

a first power supply side line which establishes electrical connection between the ignition plug and the first power supply and which is electrically connected to the second power supply; and a second power supply side line which establishes electrical connection between the ignition plug and the second power supply, wherein the first power supply side line includes a first diode which prevents a current inflow from the second power supply into the first power supply or a current inflow from the first power supply into the second power supply, and an inductor disposed between the first diode and the ignition plug, and the inductor is composed of a wound metal wire and is disposed around at least a portion of the second power supply side line while being separated from at least the second power supply side line.

2. The connection device according to claim 1, wherein the second power supply side line includes a resistor connected in series.

3. The connection device according to claim 1, wherein a core member for increasing the inductance of the inductor is disposed inside the inductor.

4. The connection device according to claim 3, wherein at least a portion of the core member is interposed in the second power supply side line.

5. The connection device according to claim 3, wherein the second power supply side line includes a resistor connected in series; and at least a portion of the core member is the resistor.

6. The connection device according to claim 3, wherein the second power supply side line includes a resistor connected in series; and the core member is disposed between the resistor and the second power supply.

7. The connection device according to claim 1, wherein a combustion apparatus to which the ignition plug is attached has a cylindrical plug hole into which the ignition plug is inserted; and at least a portion of the inductor is disposed in the plug hole.

8. The connection device according to claim 7, wherein the plug hole has a cylindrical wall which defines the plug hole; and a core member for increasing the inductance of the inductor is disposed between the cylindrical wall and the second power supply side line.

9. The connection device according to claim 1, wherein the second power supply side line includes a resistor connected in series; and the sum of a length L1 of a path for establishing electrical connection between the inductor and the ignition plug and a length L2 of a path for establishing electrical connection between the resistor and the ignition plug is 5.0 cm or less.

10. The connection device according to claim 1, wherein the inductor has a resistance of 1Ω or less.

11. The connection device according to claim 1, wherein the second power supply side line includes a second diode which prevents a current inflow from the first power supply into the second power supply or a current inflow from the second power supply into the first power supply.

12. The connection device according to claim 1, wherein a combustion apparatus to which the ignition plug is attached has a cylindrical plug hole into which the ignition plug is inserted; and at least a portion of the first diode is disposed outside the plug hole.

13. An ignition apparatus used for an ignition plug including a center electrode, a ground electrode, and a gap formed between the two electrodes, the ignition apparatus comprising:

the connection device according to claim 1; and a capacitance section which is electrically connected to the first power supply side line and is provided parallel to the ignition plug, and the capacitance section including a capacitance.

14. An ignition apparatus used for an ignition plug including a center electrode, a ground electrode, and a gap formed between the two electrodes, the ignition apparatus comprising:

the connection device according to claim 1;

a first power supply which is electrically connected to the first power supply side line and which supplies electric power to the gap; and a second power supply which is electrically connected to the second power supply side line and which apples a voltage to the gap.

15. An ignition system comprising:

the ignition apparatus according to claim 13; and an ignition plug to which electric power is supplied from the ignition apparatus.

16. An ignition system comprising:

the ignition apparatus according to claim 14; and an ignition plug to which electric power is supplied from the ignition apparatus.

* * * * *